US007685911B2

(12) United States Patent
Wu

(10) Patent No.: US 7,685,911 B2
(45) Date of Patent: Mar. 30, 2010

(54) MONKEY WRENCH

(75) Inventor: Arthur Wu, Taichung (TW)

(73) Assignee: Proxene Tools Co., Ltd., Taichung (TW)

( * ) Notice: Subject to any disclaimer, the term of this patent is extended or adjusted under 35 U.S.C. 154(b) by 4 days.

(21) Appl. No.: 12/143,751

(22) Filed: Jun. 20, 2008

(65) Prior Publication Data

US 2008/0245196 A1 Oct. 9, 2008

Related U.S. Application Data

(63) Continuation-in-part of application No. 11/515,186, filed on Sep. 5, 2006, now abandoned.

(51) Int. Cl.
*B25B 13/16* (2006.01)

(52) U.S. Cl. ..... 81/170; 81/129; 81/166; 81/167

(58) Field of Classification Search ..... 81/129, 81/166, 167, 170
See application file for complete search history.

(56) References Cited

U.S. PATENT DOCUMENTS 3,881,377 A * 5/1975 Evans et al. ..... 81/186
4,838,132 A * 6/1989 Pyles ..... 81/111
5,305,667 A * 4/1994 Caballero ..... 81/165
6,370,989 B1 * 4/2002 Baker ..... 81/170

* cited by examiner

*Primary Examiner*—Joseph J Hail, III
*Assistant Examiner*—Shantese McDonald
(74) *Attorney, Agent, or Firm*—Banger Shia

(57) ABSTRACT

A monkey wrench includes a handle, a head, stationary jaw, a movable jaw and a jaw-moving element. The head is formed at an end of the handle and made with a side, a groove in the side and an opening in communication with the groove. The stationary jaw is formed on the head and made with a first nut-contacting face, a second nut-contacting face next to the first nut-contacting face, a bulge on the first nut-contacting face and a recess next to the bulge. The movable jaw is movably disposed in the groove and formed with a nut-contacting face and a bulge on the nut-contacting face thereof. The jaw-moving element is disposed in the opening and engaged with the movable jaw so that the jaw-moving element is operable to move the movable jaw relative to the stationary jaw.

6 Claims, 8 Drawing Sheets

MONKEY WRENCH

CROSS-REFERENCE

The present application is a Continuation in Part (CIP) of U.S. application Ser. No. 11/515,186, and claims the priority of the filing date of 5 Sept. 2006 now abandoned. Claims 1, 2, 3, 4, 5 and 6 in the current CIP application correspond to claims 1, 2, 3, 4, 5 and 7 in the parent application, respectively, and are entitled to the parent application's filing date of 5 Sep. 2006.

FIELD OF INVENTION

The present invention relates to a monkey wrench and, more particularly, to a monkey wrench for preventing the chamfering of the corners of a nut.

BACKGROUND OF INVENTION

An open-end or monkey wrench includes two jaws for contact with two facets of a nut so that the nut can be driven with the wrench. The corners of the nut might however be chamfered due to forces exerted thereon when the wrench is used improperly. In an attempt to solve this problem, as disclosed in U.S. Pat. No. 4,838,132, a monkey wrench is provided with two jaws for contact with the middle points of two of the facets of a nut. The corners might nevertheless be chamfered with the monkey wrench.

Therefore, the present invention is intended to obviate or at least alleviate the problems encountered in prior art.

SUMMARY OF INVENTION

It is the primary objective of the present invention to provide a monkey wrench for preventing the chamfering of the corners of a nut.

To achieve the foregoing objective, the monkey wrench includes a handle, a head, stationary jaw, a movable jaw and a jaw-moving element. The head is formed at an end of the handle and made with a side, a groove in the side and an opening in communication with the groove. The stationary jaw is formed on the head and made with a first nut-contacting face, a second nut-contacting face next to the first nut-contacting face, a bulge on the first nut-contacting face and a recess next to the bulge. The movable jaw is movably disposed in the groove and formed with a nut-contacting face and a bulge on the nut-contacting face thereof. The jaw-moving element is disposed in the opening and engaged with the movable jaw so that the jaw-moving element is operable to move the movable jaw relative to the stationary jaw. The angle between the first nut-contacting face of the stationary jaw and the axis of the jaw-moving element is 65 to 85 degrees. In the stationary jaw, the distance between an end of the second nut-contacting face and a line passing an opposite end of the second nut-contacting face and the peak of the bulge of the stationary jaw is no bigger than the largest distance between the jaws. The distance between the peak of the bulge of the movable jaw measured and the side of the head is 35% to 47% of the largest distance between the jaws to make sure that the bulge of the movable jaw abuts the middle point of a facet of any nut.

Other objectives, advantages and features of the present invention will be apparent from the following description referring to the attached drawings.

BRIEF DESCRIPTION OF DRAWINGS

The present invention will be described via the detailed illustration of several embodiments referring to the drawings.

DETAILED DESCRIPTION OF EMBODIMENTS

Figure 1:
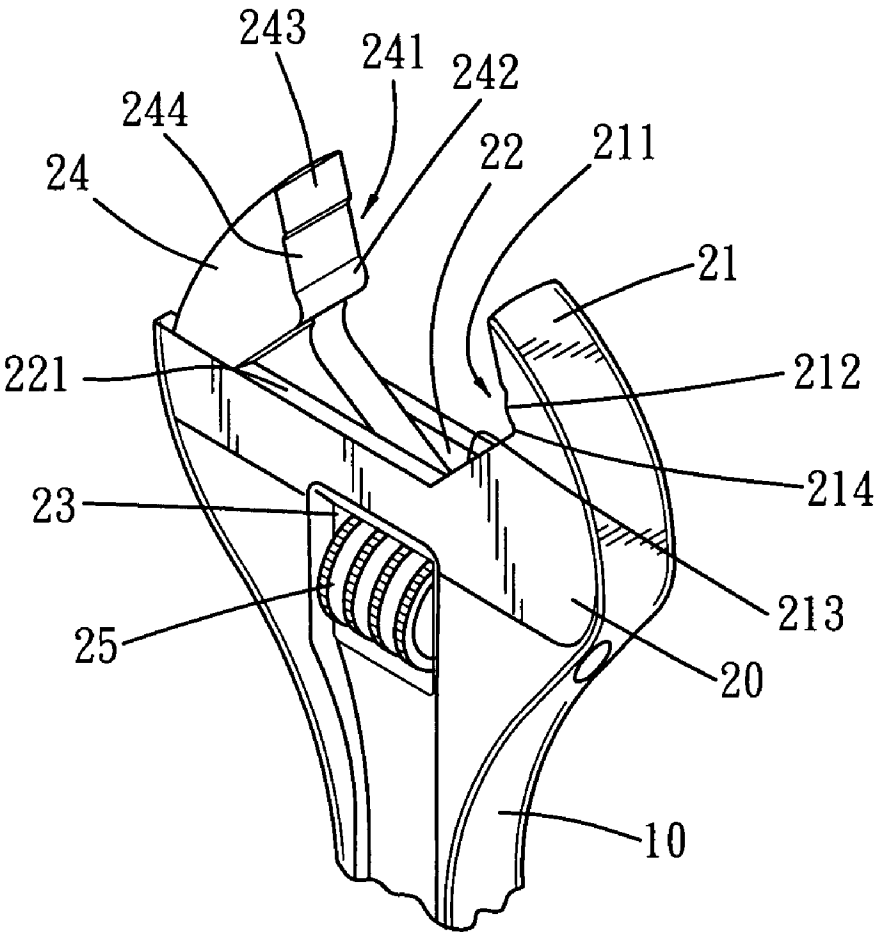
FIG. 1 is a partial perspective view of a monkey wrench according to the first embodiment of the present invention.
Figure 2:
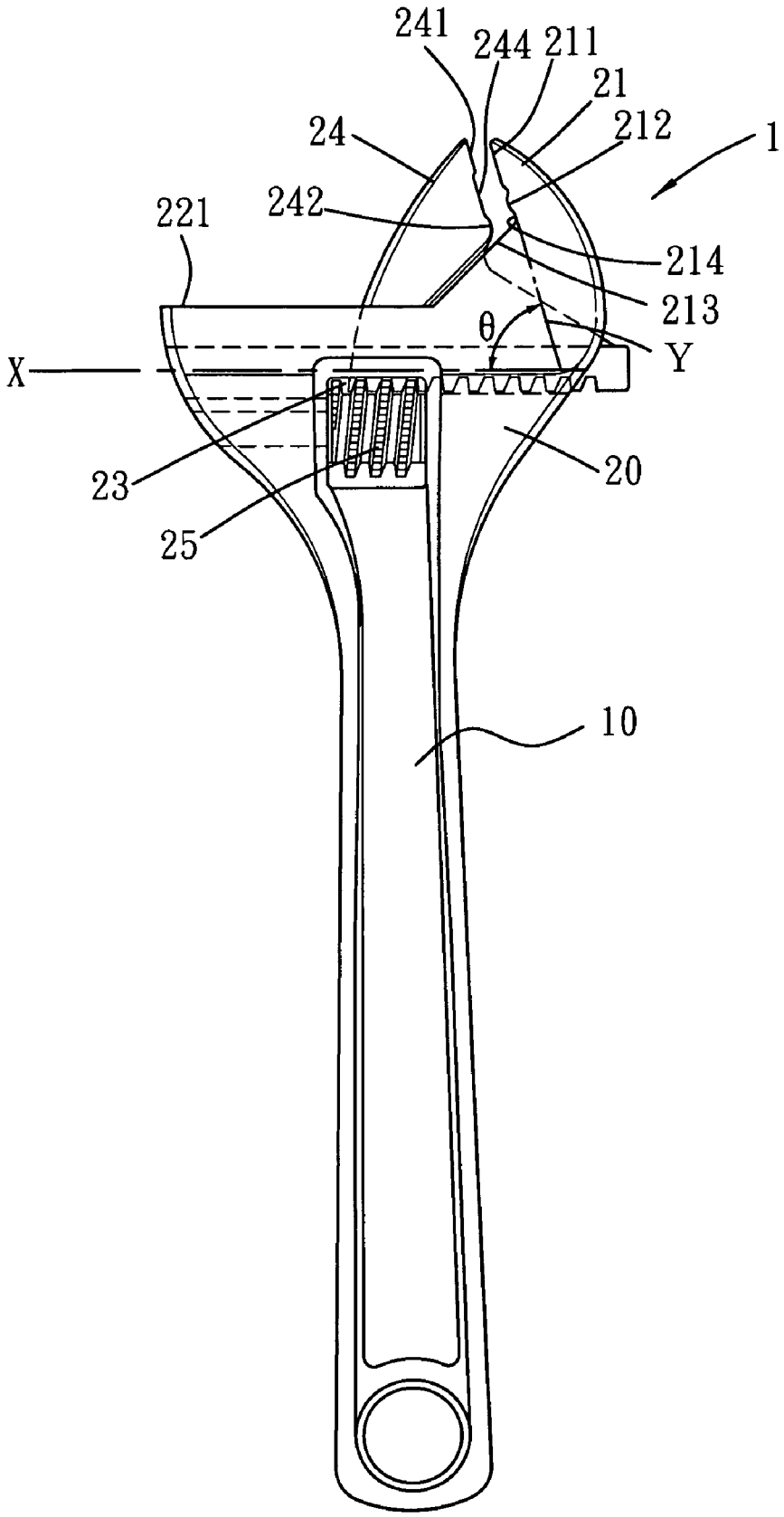
FIG. 2 is a side view of the monkey wrench shown in FIG. 1.

Referring to FIGS. 1 and 2, there is shown a monkey wrench 1 according to a first embodiment of the present invention. The monkey wrench 1 includes a handle 10, a head 20, a stationary jaw 21, a movable jaw 24 and a jaw-moving element 25. The head 20 is formed at an end of the handle 10. The stationary jaw 21 is formed on the head 20, i.e., they are made as one. The movable jaw 24 is connected to the head 20. A jaw-moving element 25 is provided on the head 20 and engaged with the movable jaw 24 so that the worm gear 25 is operable to move the movable jaw 24 relative to the stationary jaw 21.

The head 20 includes a groove 22 defined in a side 221 thereof and an opening 23 in communication with the groove 22.

The stationary jaw 21 includes a first nut-contacting face 211 and a second nut-contacting face 213 next to the first nut-contacting face 211. Two recesses 214 are defined in the first nut-contacting face 211 so that a bulge 212 is formed between the recesses 214. The peak of the bulge 212 is flat or round.

The movable jaw 24 includes a nut-contacting face 241 parallel to the first nut-contacting face 211 of the stationary jaw 21. A recess 244 is defined in the nut-contacting face 241, thus forming a bulge 242 next thereto. The peak of the bulge 242 is flat or round. The stationary jaw 21 is preferably formed with a rack movably disposed in the groove 22. The peak of the bulge 242 of the movable jaw 24 and the peak of the bulge 212 of the stationary jaw 21 respectively contact two opposite facets of a nut as the monkey wrench 1 secures the nut.

The jaw-moving element 25 is preferably a worm gear disposed in the opening 23. The worm gear 25 is engaged with the rack of the movable jaw 24. The worm gear 25 and the rack of the movable jaw 24 can be replaced with any other proper elements for moving the movable jaw 24 relative to the stationary jaw 21.

Figure 5:
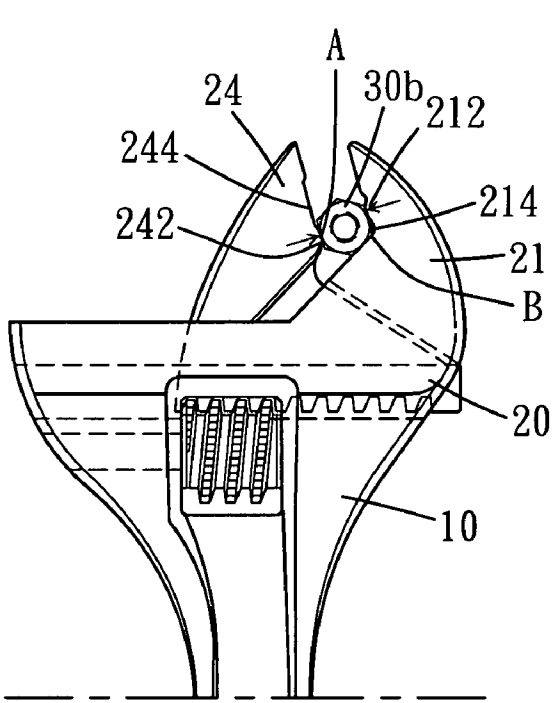
FIG. 5 is a side view of another nut rotated with the monkey wrench shown in FIG. 1.
Figure 4:
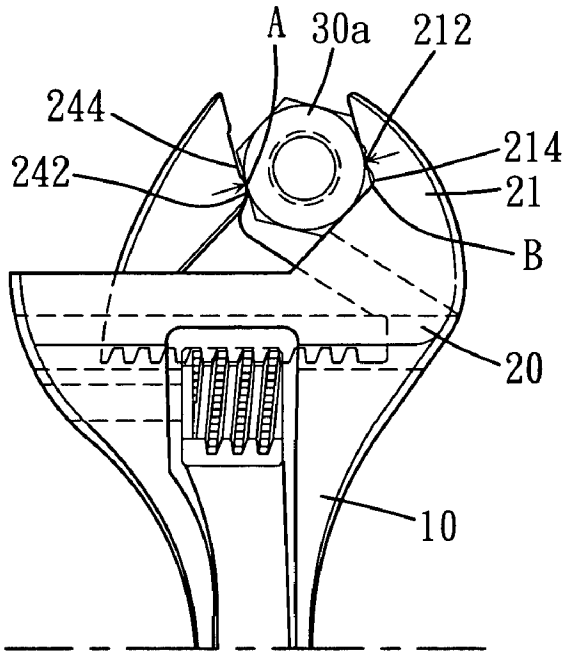
FIG. 4 is a side view of another nut rotated with the monkey wrench shown in FIG. 1.
Figure 3:
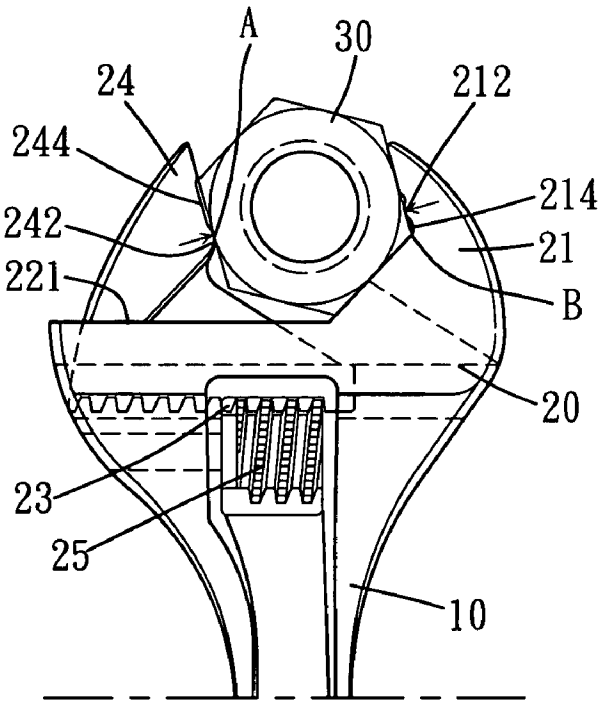
FIG. 3 is a side view of a nut rotated with the monkey wrench shown in FIG. 1.

Referring to FIGS. 3 to 5, a nut 30, 30*a* or 30*b* can be driven with the monkey wrench 1. The nut 30, 30*a* or 30*b* includes six facets and six corners. The middle point of a facet of the nut is in contact with the bulge 212 of the stationary jaw 21 while the middle point of an opposite facet is in contact with the bulge 242 of the movable jaw 24. Another one of the facets of the nut is in contact with the second nut-contacting face 213 of the stationary jaw 21. None of the corners of the nut is in contact with the jaws 21 and 24 so that none of the corners would be chamfered by the jaws 21 and 24.

Figure 9:
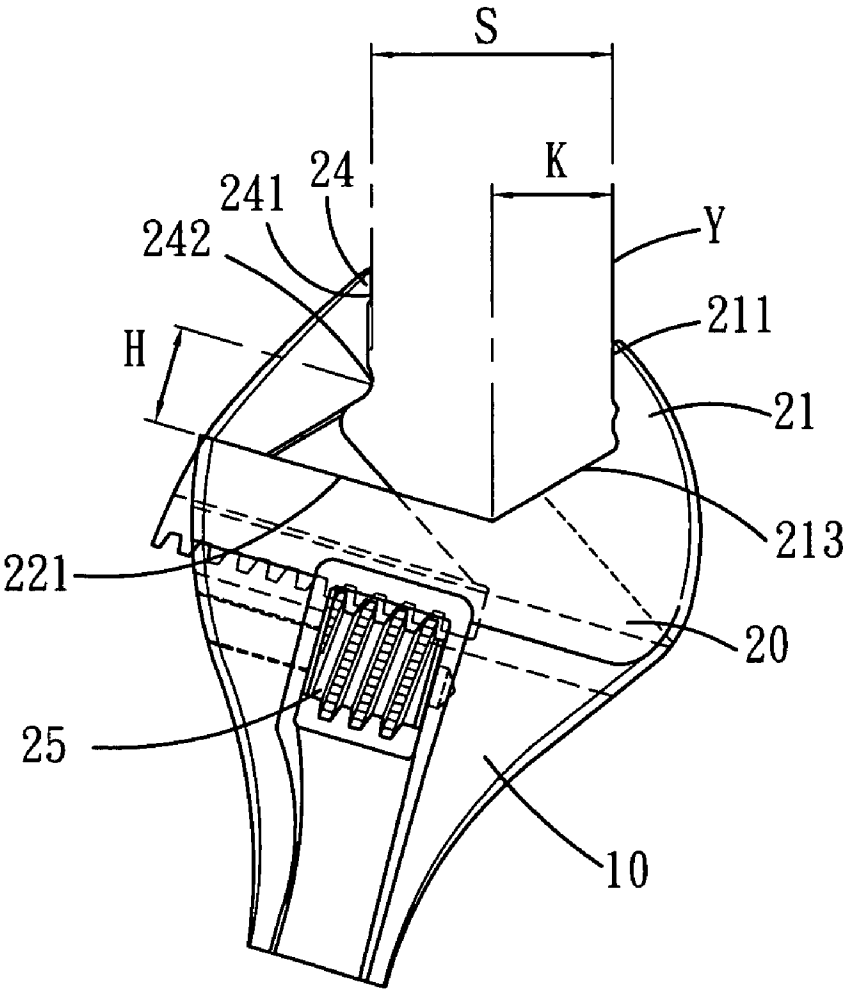
FIG. 9 is a partial side view of the monkey wrench shown in FIG. 1 for showing the relation of a second nut-contacting face of the stationary jaw related to the largest distance between the first nut-contacting face of the stationary jaw and a movable jaw.

Referring to FIG. 9, the line Y passes an end of the second nut-contacting face 213 and the peak of the bulge 212 of the stationary jaw 21. The distance K between an opposite end of the second nut-contacting face 213 of the stationary jaw 21 and the line Y is no bigger than the largest distance S between the first nut-contacting face 211 of the stationary jaw 21 and the nut-contacting face 241 of the movable jaw 24. Thus, it is made sure that the second nut-contacting face 213 is large enough to encompass the facets of the largest nut 30 for which the monkey wrench 1 is designed.

The distance H between the bulge 242 of the movable jaw 24 and the side 221 of the head 20 is about 35% to 47% of the distance S so that the bulge 242 of the movable jaw 24 abuts the middle point of the facet A of each of the nuts.

Referring to FIG. 2, there is a line X parallel to the axis of the worm gear 25. There is a line Y parallel to the first nut-contacting face 211. The angle ¦ between the lines X and Y is 65 to 85 degrees and, preferably, 74 degrees.

Figure 7:
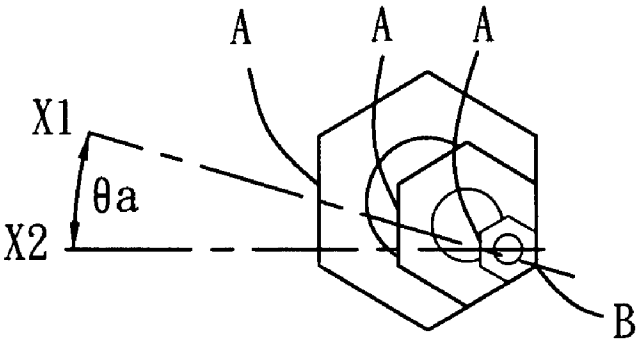
FIG. 7 is a side view of the nuts shown in FIG. 6.
Figure 8:
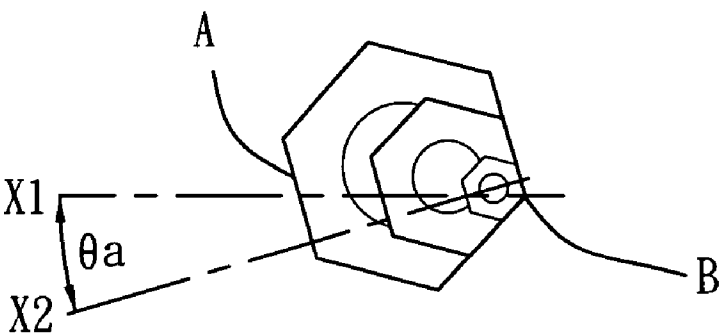
FIG. 8 is another side view of the nuts shown in FIG. 6.
Figure 6:
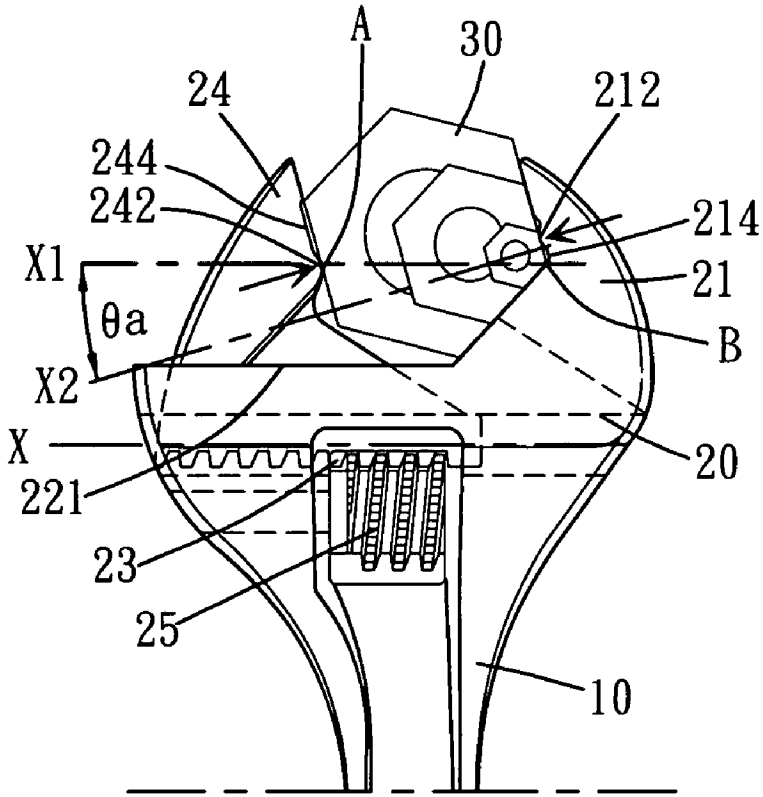
FIG. 6 is a partial side view of the nuts and the monkey wrench shown in FIGS. 3 to 5 for showing an angle between a baseline of the nuts and a line perpendicular to a first nut-contacting face of a stationary jaw.

Referring to FIGS. 6 to 8, reasons why the angle 0 is preferably 74 degrees will be given. All of the nuts 30, 30*a* and 30*b* are overlapped. A corner B of each of the nuts is located in a corner between the first and second nut-contacting faces of the stationary jaw 21. Each of the nuts includes a facet A furthest from the corner B. There is a line X1 passing the middle point of the facet A of each of the nuts. There is a line X2 perpendicular to the first nut-contacting face 211 of the stationary jaw 21. The angle 0 a between the lines X1 and X2 is 16 degrees.

The bulge 242 of the movable jaw 24 is moved along a path parallel to the line X when the movable jaw 24 is moved towards the stationary jaw 21. To assure that the bulge 242 of the movable jaw 24 abuts the middle point of the facet A of each of the nuts, the path of the bulge 242 of the movable jaw 24 must be overlapped with the line X1. Hence, the lines X1 and X2 must be in the position shown in FIG. 8 instead of the position shown in FIG. 7. The angle 0 between the lines X and Y is 74 degrees accordingly.

Figure 10:
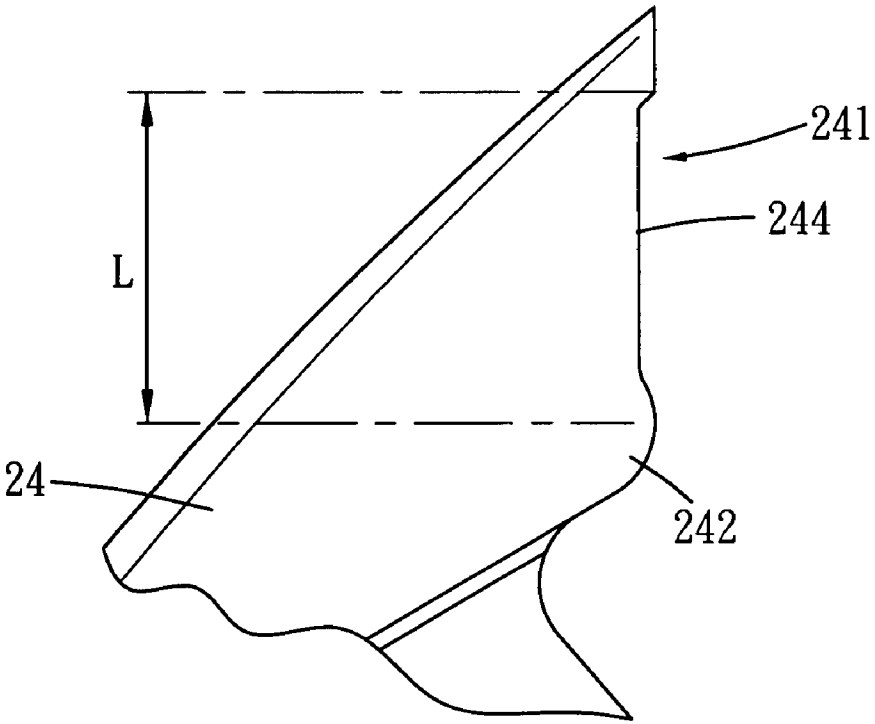
FIG. 10 is a partial side view of the movable jaw shown in FIG. 1.

Referring to FIG. 10, the length L of the recess 244 of the movable jaw 24 is larger than one second of the length of each facet of the largest nut 30 for which the monkey wrench 1 is designed. Thus, it is made sure that one of the corners of a nut is disposed in the recess 214 of the stationary jaw 21 when the middle point A of one of the facets of the nut is abutted with the bulge 242 of the movable jaw 24.

The difference between the peak of the bulge 242 and the floor of the recess 244 must be adequate so that one of the corners of a nut can be disposed in the recess 244 without contacting the movable jaw 24.

Figure 12:
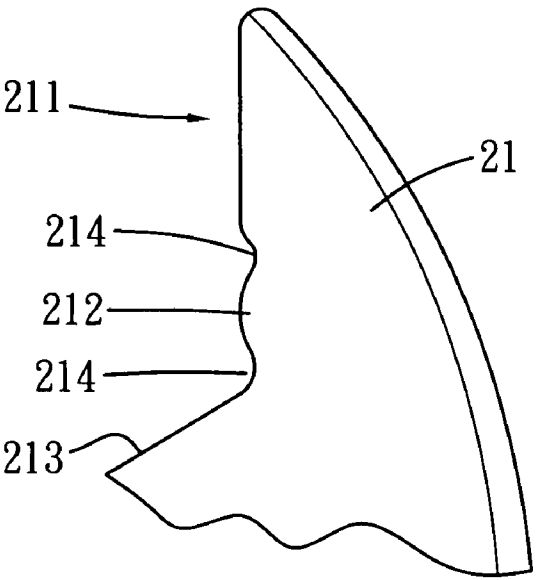
FIG. 12 is a partial side view of the stationary jaw shown in FIG. 1.

Referring to FIG. 12, the difference between the peak of the bulge 212 and the floors of the recesses 214 must be enough adequate so that one of the corners of a nut can be disposed in the recess 214 without contacting the stationary jaw 21.

Figure 11:
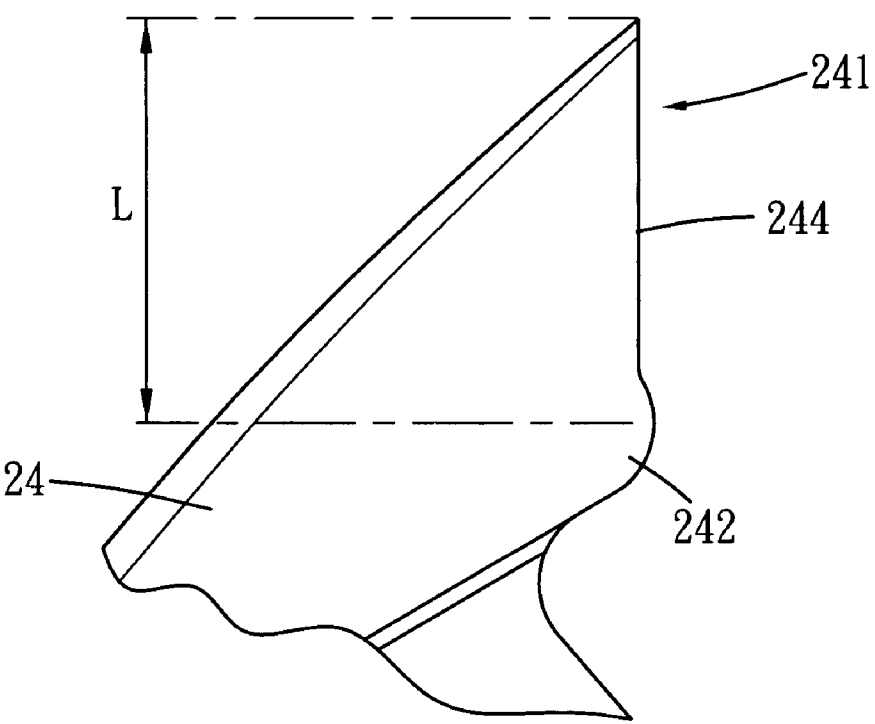
FIG. 11 is a partial side view of a movable jaw according to the second embodiment of the present invention.

Referring to FIG. 11, there is a movable jaw 24 according to the second embodiment of the present invention. The second embodiment is like the first embodiment except that the length L is larger.

Figure 13:
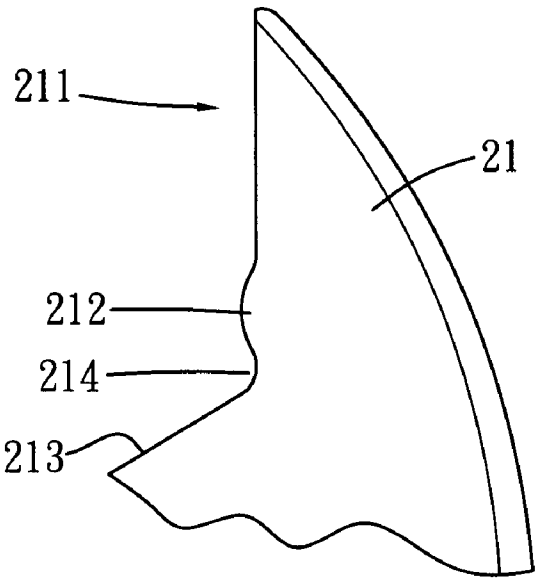
FIG. 13 is a partial side view of a stationary jaw according to the third embodiment of the present invention.

Referring to FIG. 13, there is a stationary jaw 21 according to the third embodiment of the present invention. The third embodiment is like the first embodiment except that the stationary jaw 21 includes only one recess 214.

Figure 14:
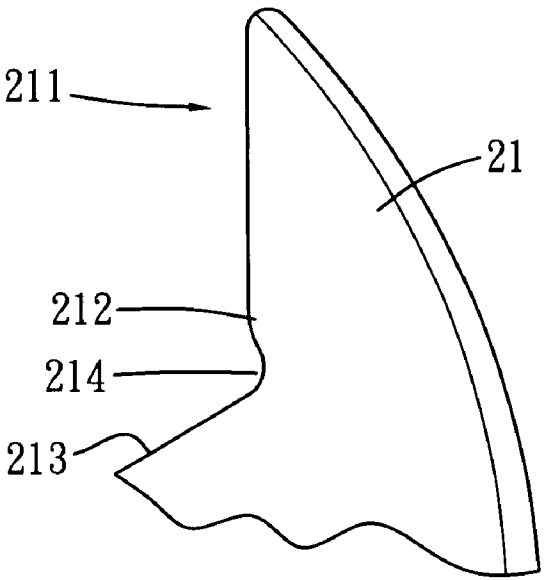
FIG. 14 is a partial side view of a stationary jaw according to the fourth embodiment of the present invention.

Referring to FIG. 14, there is a stationary jaw 21 according to the fourth embodiment of the present invention. The fourth embodiment is like the third embodiment except that the bulge 212 of the stationary jaw 21 is longer.

Figure 15:
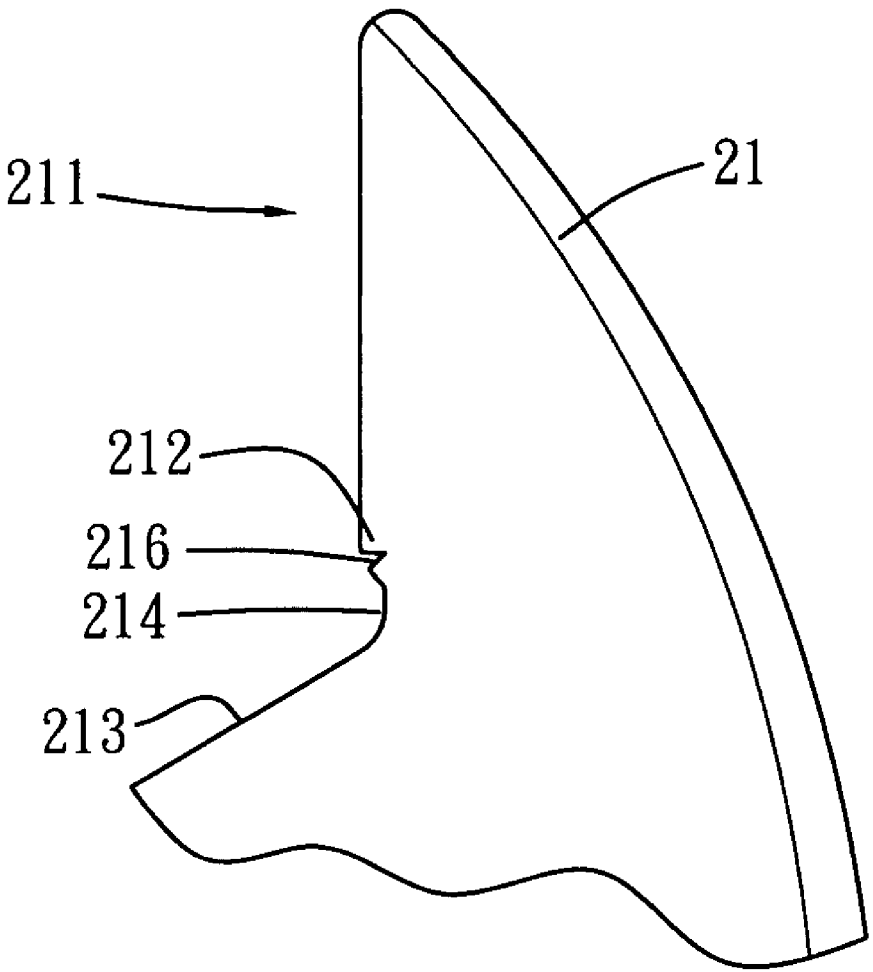
FIG. 15 is a partial side view of a stationary jaw according to the fifth embodiment of the present invention.

Referring to FIG. 15, there is a stationary jaw 21 according to the fifth embodiment of the present invention. The fifth embodiment is like the fourth embodiment except that the stationary jaw 21 includes a tooth 216 formed on the floor of the recess 214.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A monkey wrench comprising:

a handle;

a head formed at an end of the handle and formed with a side, a groove in the side and an opening in communication with the groove;

a stationary jaw formed on the head and formed with a first nut-contacting face, a second nut-contacting face next to the first nut-contacting face, a bulge on the first nut-contacting face and a recess next to the bulge;

a movable jaw movably disposed in the groove and formed with a nut-contacting face and a bulge on the nut-contacting face thereof; and a jaw-moving element disposed in the opening and engaged with the movable jaw so that the jaw-moving element is operable to move the movable jaw relative to the stationary jaw;

wherein an angle between the first nut-contacting face of the stationary jaw and an axis of the jaw-moving element is 65 to 85 degrees;

wherein in the stationary jaw, a distance between an end of the second nut-contacting face and a line passing an opposite end of the second nut-contacting face and a peak of the bulge of the stationary jaw is no bigger than a largest distance between the jaws;

wherein a distance between a peak of the bulge of the movable jaw and the side of the head is 35% to 47% of the largest distance between the jaws to make sure that the bulge of the movable jaw abuts a middle point of a facet of any nut;

wherein the peak of the bulge of the stationary jaw and the peak of the bulge of the movable jaw respectively contact two opposite facets of a nut as the monkey wrench secures the nut.

2. The monkey wrench according to claim 1, wherein the angle between the first nut-contacting face of the stationary jaw and the axis of the jaw-moving element is 74 degrees.

3. The monkey wrench according to claim 1, wherein the stationary jaw—comprises a tooth formed on a floor of the recess thereof.

4. The monkey wrench according to claim 1, wherein the peak of the bulge of each of the jaws is flat.

5. The monkey wrench according to claim 1, wherein the peak of the bulge of each of the jaws is round.

6. The monkey wrench according to claim 1, wherein a length of a recess of the movable jaw is larger than one second of a length of each facet of a largest nut for which the monkey wrench is designed.

* * * * *